US011367976B2

(12) United States Patent
Hosoda

(10) Patent No.: US 11,367,976 B2
(45) Date of Patent: Jun. 21, 2022

(54) ELECTRIC CONNECTOR INCLUDING A HOUSING AND REINFORCING METAL FITTINGS

(71) Applicant: HIROSE ELECTRIC CO., LTD., Tokyo (JP)

(72) Inventor: Shohei Hosoda, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 157 days.

(21) Appl. No.: 16/890,711

(22) Filed: Jun. 2, 2020

(65) Prior Publication Data

US 2020/0395704 A1 Dec. 17, 2020

(30) Foreign Application Priority Data

Jun. 11, 2019 (JP) ..... JP2019-108590

(51) Int. Cl.
*H01R 13/502* (2006.01)
*H01R 24/60* (2011.01)

(52) U.S. Cl.
CPC ..... *H01R 13/502* (2013.01); *H01R 24/60* (2013.01)

(58) Field of Classification Search
CPC .... H01R 13/502; H01R 24/60; H01R 13/405; H01R 12/707; H01R 12/716; H01R 12/73; H01R 13/20
See application file for complete search history.

(56) References Cited

U.S. PATENT DOCUMENTS

| | | | | |
|---|---|---|---|---|
| 9,362,637 | B2 * | 6/2016 | Hasegawa | H01R 12/716 |
| 9,899,771 | B2 * | 2/2018 | Ashibu | H01R 12/716 |
| 10,003,148 | B2 * | 6/2018 | Ashibu | H01R 13/2492 |
| 10,396,484 | B2 * | 8/2019 | Chen | H01R 12/7088 |
| 2017/0264048 | A1 | 9/2017 | Ashibu et al. | |
| 2019/0363467 | A1 * | 11/2019 | Ko | H01R 12/7005 |

FOREIGN PATENT DOCUMENTS

| | | |
|---|---|---|
| JP | 3206448 | 9/2016 |
| JP | 2016-195056 | 11/2016 |
| JP | 6498622 | 3/2019 |

OTHER PUBLICATIONS

Japanese Office Action dated Nov. 2, 2021, 3 pages.

* cited by examiner

*Primary Examiner* — Michael C Zarroli
(74) *Attorney, Agent, or Firm* — Rankin, Hill & Clark LLP

(57) ABSTRACT

An electric connector includes a housing and a pair of reinforcing metal fittings. The housing has a bottom wall having a rectangular shape, a pair of short walls, a pair of long walls, and an island-shaped protruding wall surrounded by the short walls and the long walls. The reinforcing metal fitting has an upper plate part along an upper face of the short wall, an outer plate part along an outer side face of the short wall, and a pair of side plate parts extending from the upper plate part along inner side faces of the pair of long walls. The pair of side plate parts has a mounting part to be fixed to a mounting face and a long wall reinforcing wall part whose plate thickness face is directed in a direction in which the long wall is stood.

8 Claims, 8 Drawing Sheets

ELECTRIC CONNECTOR INCLUDING A HOUSING AND REINFORCING METAL FITTINGS

INCORPORATION BY REFERENCE

This application is based on and claims the benefit of priority from Japanese Patent application No. 2019-108590 filed on Jun. 11, 2019, which is incorporated by reference in its entirety.

TECHNICAL FIELD

The present invention relates to an electric connector.

BACKGROUND

An electric connector mounted on a circuit board or the others is known, in which a reinforcing metal fitting is embedded in a resin housing to enhance robustness (for example, refer to patent literature 1 (Japanese Patent Registration number 6498622)). The housing of the electric connector of the patent literature 1 has a bottom wall having a rectangular shape in a plan view, a pair of long walls and a pair of short walls which are stood from the four sides of the bottom wall, and island-shaped protruding wall provided inside the pair of long walls and the pair of short walls. The reinforcing metal fittings are embedded in both the end portions in the long side direction of the housing, and both the end portions of the short walls and the long walls in the long side direction are reinforced by the reinforcing metal fittings to ensure the robustness of the electric connector.

The reinforcing metal fitting is formed by folding a metal plate punched in predetermined shape, and has a short wall reinforcing part to reinforce the short wall of the housing and a long wall reinforcing part to reinforce the long wall of the housing. The short wall reinforcing part is formed so as to extend along the upper face of the short wall. The long wall reinforcing part is formed into a U-shape in a cross section, and has an upper plate part along the upper face of the long wall and a pair of side plate parts along the inner side face and the outer side face of the long wall. Then, in both the end portions of the housing in the long side direction, the long walls and the short walls are protected by the reinforcing metal fittings when the connectors are inserted and removed from each other.

SUMMARY OF THE INVENTION

Because the reinforcing metal fitting of the patent literature 1 is formed by folding a metal plate, the corners between the upper plate part of the long wall reinforcing part having a U-shape in a cross section and the pair of side plate parts are formed into a round shape. Thereby, a distance between the side plate parts is increased by the roundness of the corners, a thickness of the long wall protected by the pair of side plate parts is increased, and a size of the housing in the short side direction is increased.

The present invention is made in the above described view and provides an electric connector capable of having a small size while ensuring robustness.

To achieve the object, a first aspect of an electric connector comprising a housing and a pair of reinforcing metal fittings, wherein the housing is formed into a rectangular shape in a plan view and has a plurality of signal terminals, and the pair of reinforcing metal fittings reinforces both end portions of the housing in a long side direction of the housing, wherein the housing has a bottom wall having a rectangular shape in a plan view, a pair of short walls stood from both short sides of the bottom wall, a pair of long walls stood from both long sides of the bottom wall, and an island-shaped protruding wall surrounded by the pair of short walls and the pair of long walls, the reinforcing metal fitting has an upper plate part along an upper face of the short wall, an outer plate part extending from the upper plate part so as to be along an outer side face of the short wall, and a pair of side plate parts extending from the upper plate part along inner side faces of the pair of long walls, and the pair of side plate parts has a mounting part to be fixed to a mounting face and a long wall reinforcing wall part whose plate thickness face is directed in a direction in which the long wall is stood.

EFFECT OF THE INVENTION

According to the electric connector of the first aspect, if the connectors interfere with each other at the connection of the connectors, because the plate thickness face of the long wall reinforcing part is directed in a direction in which the long wall is stood, the long wall is protected from an excessive load in the insertion and removal direction of the connector by the plate thickness face of the long wall reinforcing part. At this time, a load applied to the long wall reinforcing part can be received by the mounting part so that it becomes possible to heighten robustness of the electric connector. Additionally, the long wall reinforcing part is formed by the side plate part so that it becomes possible to decrease a thickness of the pair of long walls and to decrease a size of the electric connector in the short side direction. Accordingly, it becomes possible to realize the decreasing of a size of the electric connector while ensuring robustness of the electric connector.

DETAILED DESCRIPTION

Figure 1:
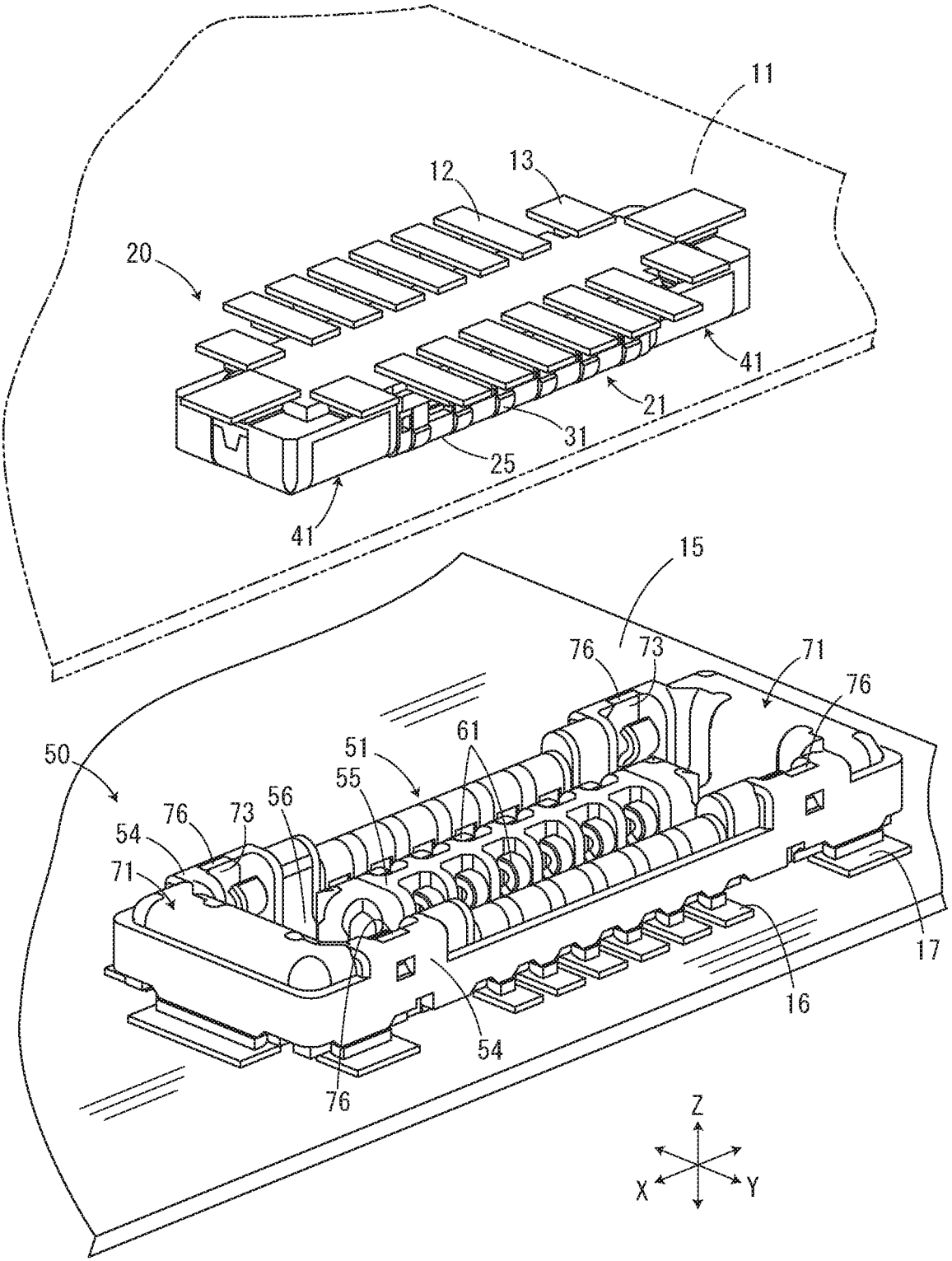
FIG. 1 is a perspective view showing a plug connector and a receptacle connector according to the present embodiment.

Hereinafter, with reference to the attached drawings, a present embodiment will be described in detail. FIG. 1 is a perspective view showing a plug connector and a receptacle connector according to the present embodiment. For convenience of description, a plug connector side circuit board is shown by the two-dotted chain line in FIG. 1. In the following description, the side of the circuit boards of the plug connector and the receptacle connector is defined as the lower side, and the opposite side is defined as the upper side.

As shown in FIG. 1, the plug connector (a counter electric connector) 20 and the receptacle connector (an electric connector) 50 are each, so-called, a B to B (board to board) connector which electrically connects circuit boards 11 and 15 each other. On the surface (the lower side in FIG. 1) of one circuit board 11, a plurality of mounting pads 12 and 13 are provided, and the plug connector 20 is fixed to each of the mounting pads 12 and 13. In the same manner, on the surface of the other circuit board 15, a plurality of mounting pads 16 and 17 are provided, and the receptacle connector 50 is fixed to each of the mounting pads 16 and 17. The circuit boards 11 and 15 are each formed by a printed board, a flexible board or the like.

A resin housing 21 of the plug connector 20 has a rectangular annular fitting part 25, and a resin housing 51 of the receptacle connector 50 has a rectangular annular reception space 56 into which the fitting part 25 of the plug connector 20 is received. The fitting part 25 of the plug connector 20 is received into the reception space 56 of the receptacle connector 50, and each terminal 31 of the plug connector 20 exposed to the outer face of the fitting part 25 comes into contact with each terminal 61 of the receptacle connector 50 in the reception space 56. As a result, the circuit boards 11 and 15 are electrically connected each other through the plug connector 20 and the receptacle connector 50.

At the connecting of the circuit boards 11 and 15, because the plug connector 20 is hidden by one circuit board 11, it is difficult to position the plug connector 20 to the receptacle connector 50 on the other circuit board 15. When the plug connector 20 is pushed into the receptacle connector 50 in a state where the plug connector 20 is displaced to the receptacle connector 50, the housing of the receptacle connector 50 is applied with an excessive load in an insertion and removal direction Z, and the housing 51 may be damaged. Especially, in recent years, it is required to decrease a size of the connector in accordance with a decreasing of size and weight of an electric device, and a small size connector may be easily damaged when it is incorrectly attached.

Then, in the receptacle connector 50 of the present embodiment, a reinforcing metal fitting 71 is embedded in the resin housing 51 to heighten strength of the housing 51. The reinforcing metal fitting 71 has a side plate part 73 reinforcing the long wall 54 of the housing 51, the plate face of the side plate part 73 faces the inner side face of the long wall 54 and the plate thickness face 76 of the side plate part 73 is directed in a direction in which the long wall 54 is stood. The plate thickness face 76 of the side plate part 73 protects the long wall 54 from a load in the insertion and removal direction Z of the connector to ensure robustness of the receptacle connector 50. Additionally, it becomes possible to decrease a thickness of the long wall 54 of the housing 51 and to decrease a size of the receptacle connector 50.

Figure 2:
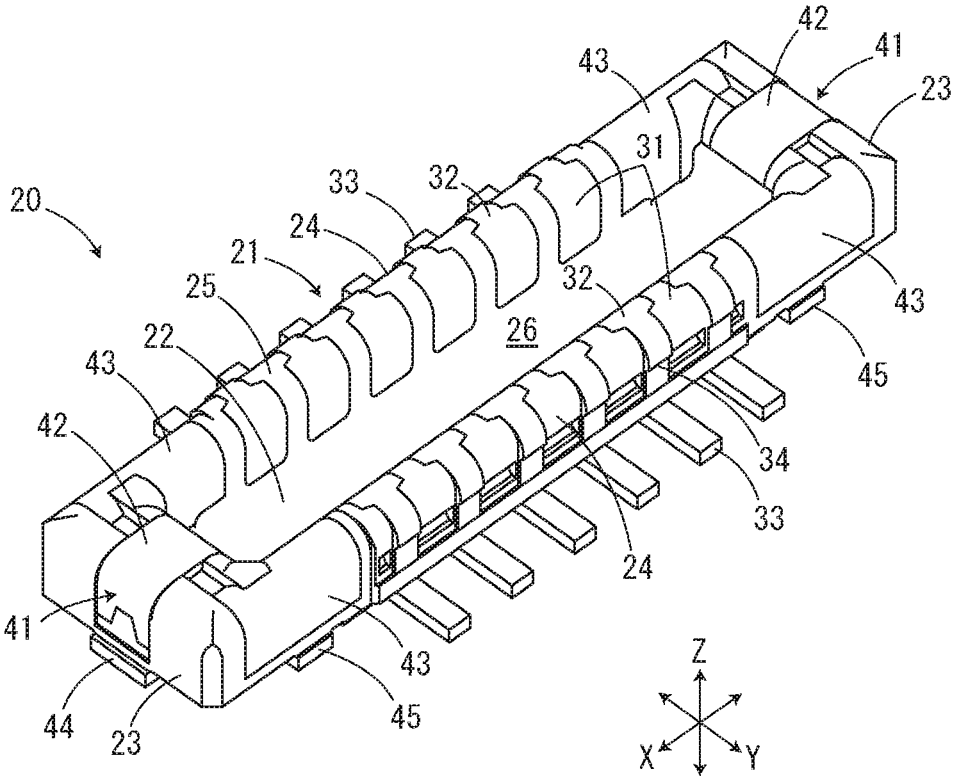
FIG. 2 is a perspective view showing the plug connector according to the present embodiment.
Figure 3:
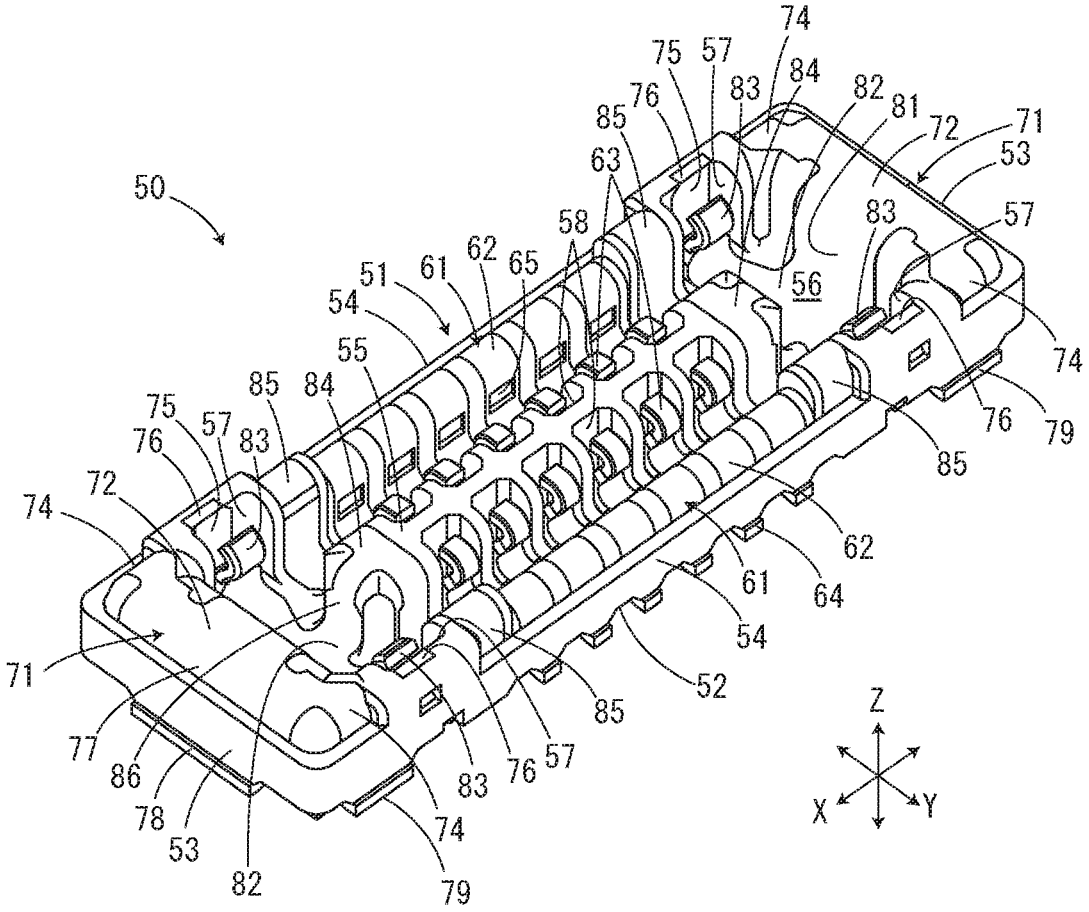
FIG. 3 is a perspective view showing the receptacle connector according to the present embodiment.
Figure 4:
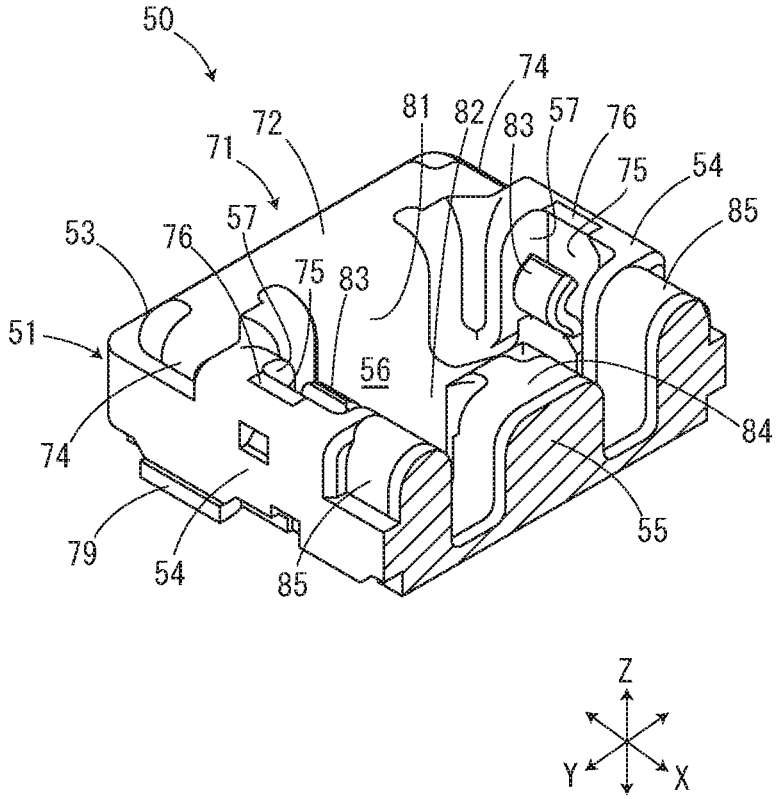
FIG. 4 is a perspective view showing the end portion of the receptacle connector according to the present embodiment.
Figure 5:
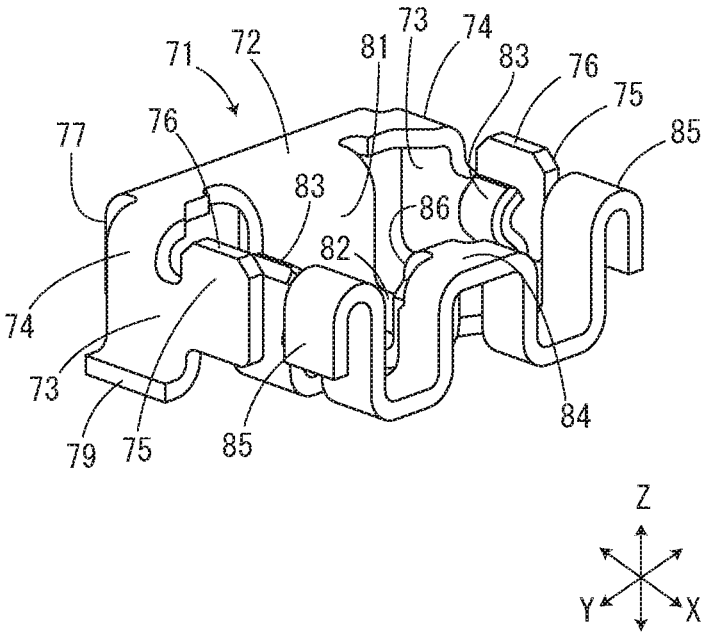
FIG. 5 is a perspective view showing a reinforcing metal fitting, when viewed from the upper side, according to the present embodiment.
Figure 6:
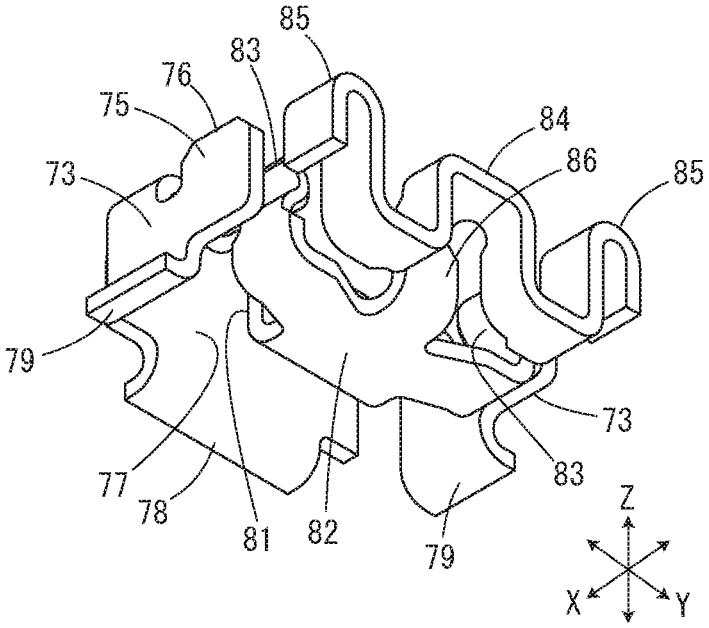
FIG. 6 is a perspective view showing the reinforcing metal fitting, when viewed from the lower side, according to the present embodiment.

With reference to FIG. 2 to FIG. 6, the plug connector and the receptacle connector will be described in detail. FIG. 2 is a perspective view showing the plug connector of the present embodiment. FIG. 3 is a perspective view showing the receptacle connector of the present embodiment. FIG. 4 is a perspective view showing the end portion of the receptacle connector of the present embodiment. FIG. 5 is a perspective view showing the reinforcing metal fitting of the present embodiment, when viewed from the upper side. FIG. 6 is a perspective view showing the reinforcing metal fitting of the present embodiment, when viewed from the lower side.

As showing in FIG. 2, the plug connector 20 is formed by insertion molding in which a plurality of the signal terminals 31 and a pair of reinforcing metal fittings 41 are embedded in the resin housing 21. The housing 21 has a bottom wall 22 having a rectangular shape in a plan view, a pair of short walls 23 stood from both the short sides of the bottom wall 22 (both the ends in the long side direction X of the bottom wall 22), and a pair of long walls 24 stood from both the long sides of the bottom wall 22 (both the ends in the short side direction Y of the bottom wall 22). The pair of short walls 23 and the pair of long walls 24 form the rectangular annular fitting part 25 received in the reception space 56 (refer to FIG. 3) of the receptacle connector 50. Inside the fitting part 25, a straight reception space 26 receiving a protruding wall 55 (refer to FIG. 3) of the receptacle connector 50 is formed.

The outer face of the fitting part 25 of the plug connector 20 is formed into a U-shape in a cross section so as to be easily received in the reception space 56 of the receptacle connector 50. On the pair of long walls 24 of the fitting part 25, the signal terminals 31 are disposed side by side. Each signal terminal 31 is formed by folding a metal piece, and has a contact part 32 having a U-shaped plate along the outer face of the long wall 24 and a mounting part 33 extending from the contact part 32 to an outside of the housing 21. The contact part 32 is formed so as to be widen on the inner side face side of the long wall 24 and to be narrowed on the outer side face side of the long wall 24. The narrowed portion of the contact part 32 has a claw 34 for preventing removal.

A space between the mounting part 33 and the contact part 32 is embedded in the resin housing 21. Thereby, when the mounting part 33 is soldered, the molten solder is prevented from being flowed along the surface of the mounting part 33 by the outer side face of the housing (the long wall 24). That is, the molten solder is blocked by an electrical isolation resin having a small wettability, and so-called solder lifting in which the solder is lifted along the surface of the mounting part 33 is prevented. By soldering each mounting part 33 to each mounting pad 12 of the circuit board 11 (refer to FIG. 1), the plug connector 20 is electrically connected to a signal processing circuit of the circuit board 11.

In both the end portions of the housing 21 in the long side direction X, the pair of reinforcing metal fittings 41 is installed. Each reinforcing metal fitting 41 is formed by folding a metal piece, and reinforces the short wall 23 and the end portions of the pair of long walls 24. Each reinforcing metal fitting 41 has a base part 42 having a U-shaped plate along the outer face of the short wall 23, a pair of contact parts 43 each having a U-shaped plate along the outer face of the long wall 24, and a plurality of mounting parts 44 and 45 respectively extending from the base part 42 and the pair of contact parts 43 to an outside of the housing 21. The contact part covers the outer face of the long wall 24, and the contact part 43 protects the long wall 24 from interference with the receptacle connector 50.

A space between the mounting part 44 and the base part 42 and a space between the mounting part 45 and the contact part 43 are embedded in the resin housing 21. Thereby, when the mounting parts 44 and 45 are soldered, the molten solder is blocked by the housing 21, and the solder lifting is prevented. By soldering each of the mounting part 44 and 45 to each mounting pad 13 of the circuit board 11 (refer to FIG. 1), the plug connector 20 is electrically connected to a power circuit of the circuit board 11. In the above manner, the pair of reinforcing metal fittings 41 reinforces both the end portions of the housing 21 in the long side direction X, and also functions as a positive side power terminal and a negative side power terminal of the plug connector 20.

As shown in FIG. 3, the receptacle connector 50 is formed by insertion molding in which the plurality of signal terminals 61 and the pair of reinforcing metal fittings 71 are embedded in the resin housing 51. The housing 51 has a bottom wall 52 having a rectangular shape in a plan view, a pair of short walls 53 stood upward from both the short sides of the bottom wall 52 (both the ends in the long side direction X of the bottom wall 52), a pair of long walls 54 stood upward from both the long sides of the bottom wall 52 (both the ends in the short side direction Y of the bottom wall 52), and the island-shaped protruding wall 55 surrounded by the pair of short walls 53 and the pair of long walls 54. In the receptacle connector 50, the pair of short walls 53, the pair of long walls 54 and the island-shaped protruding wall 55 form the rectangular annular reception space 56 receiving the fitting part 25 of the plug connector 20.

In the housing 51, the signal terminals 61 are disposed along the protruding wall 55 in two rows. Each signal terminal 61 is formed by folding a metal piece, and has a curved part 62 having a U-shaped plate along the outer face of the long wall 54, a contact spring 63 extending from one end of the curved part 62 to the protruding wall 55 and a mounting part 64 protruding from the other end of the curved part 62 to an outside of the housing 51. On the one end side of the curved part 62, a concave face 65 corresponding to the claw 34 (refer to FIG. 2) of the signal terminal 31 of the plug connector 20 is formed. The claw 34 of the signal terminal 31 of the plug connector 20 enters the concave face 65 of the signal terminal 61 of the receptacle connector 50, and the connectors are prevented from being removed from each other.

The contact spring 63 is stored in a storage groove 58 formed by cutting out the outer face of the protruding wall 55, and the inner space of the storage groove 58 allows flexure of the contact spring 63 in a thickness direction (the short side direction Y of the housing 51). The mounting part 64 protrudes from the other end side of the curved part 62 to an outside of the housing 51 through the inside of the resin long wall 54. Thereby, a space between the mounting part 64 and the curved part 62 is embedded in the housing 51, and when the mounting part 64 is soldered, the molten solder is blocked by the housing to prevent the solder lifting. By soldering each mounting part 64 to each mounting pad 16 of the circuit board 15 (refer to FIG. 1), the receptacle connector 50 is electrically connected to a signal processing circuit of the circuit board 15.

In both the end portions of the housing 51 in the long side direction X, the pair of reinforcing metal fittings 71 is installed. Each reinforcing metal fitting 71 is formed by folding a metal piece, and reinforces the short wall 53, the end portions of the pair of long walls 54 and the end portion of the island-shaped protruding wall 55. Each reinforcing metal fitting 71 has a pair of contact springs 83 contactable to the contact part 43 of the reinforcing metal fitting 41 of the plug connector 20. As described above, in the same manner as the plug connector 20, in the receptacle connector 50, the pair of reinforcing metal fittings 71 reinforces both the end portions of the housing 51 in the long side direction X, and also functions as a positive side power terminal and a negative side power terminal of the receptacle connector 50.

As shown in FIG. 3 to FIG. 6, the reinforcing metal fitting 71 has an upper plate part 72 along the upper face of the short wall 53 and a pair of side plate parts 73 extending from the upper plate part 72 along the inner side faces of the pair of long walls 54. The upper plate part 72 covers the upper face of the short wall 53, and the upper plate part 72 protects the short wall 53 from an excessive load in the insertion and removal direction Z of the connector. The side plate part 73 has a coupling part 74 and a long wall reinforcing part 75 which are disposed on both sides of the cutout of the upper edge (refer to FIG. 5, in particularly). The coupling part 74 is connected to the upper plate part 72. The long wall reinforcing part 75 has the plate thickness face 76 directed in a direction in which the long wall 54 is stood. The plate thickness face 76 of the long wall reinforcing part 75 is exposed from the upper face of the long wall 54, and the plate thickness face 76 of the long wall reinforcing part 75 protects the long wall 54 from an excessive load in the insertion and removal direction Z of the connector.

An outer plate part 77 extends from the upper plate part 72 along the outer side wall of the short wall 53, and on the lower end portions of the outer plate part 77 and the pair of side plate parts 73, mounting parts 78 and 79 are respectively formed. The outer plate part 77 between the mounting part 78 and the upper plate part 72 and the side plate part 73 between the mounting part 79 and the upper plate part 72 are embedded in the resin housing 51. Thereby, when the mounting parts 78 and 79 are soldered, the molten solder is blocked by the housing 51, and the solder lifting is prevented. By soldering each of the mounting parts 78 and 79 to each mounting pad (a mounting face) 17 of the circuit board 15 (refer to FIG. 1), the receptacle connector 50 is electrically connected to a power circuit of the circuit board 15.

In this case, because a current flowing through the reinforcing metal fitting 71 is distributed by the plurality of mounting parts 78 and 79, it becomes possible to increase current capacity of a source current of the receptacle connector 50 and to increase a heat radiation area. Additionally, the mounting part 79 is disposed just below the coupling part 74 side of the long wall reinforcing part 75 (refer to FIG. 5, in particularly). That is, the long wall reinforcing part 75 extends perpendicularly from the mounting part 79, and the long wall reinforcing part 75 is supported by the mounting part 79 from the lower side. Thereby, a load applied to the long wall reinforcing part 75 is received by the mounting part 79, and deformation of the long wall reinforcing part 75 is inhibited so that robustness of the receptacle connector 50 is heightened.

Additionally, the reinforcing metal fitting 71 has an inner plate part 81, a bottom plate part 82 and a pair of contact springs 83. The inner plate part 81 extends from the upper plate part 72 along the inner side face of the short wall 53. The bottom plate part 82 extends from the lower end portion of the inner plate part 81 along the bottom wall 52. The pair of contact springs 83 extends from the bottom plate part 82 to the pair of long walls 54 and stands along the pair of long walls 54. The pair of contact springs 83 stands from the bottom plate part 82 so as to face the pair of long wall reinforcing parts 75, and the contact spring 83 is stored in a storage groove 57 formed by cutting out the inner side face of the long wall 54. The long wall reinforcing part 75 is exposed from the storage groove 57, the storage groove 57 forms a space between the long wall reinforcing part 75 and the contact spring 83, and the space allows flexure of the contact spring 83 in a plate thickness direction (the short side direction Y of the housing 51). The exposure of the long wall reinforcing part 75 ensure a heat radiation area.

The reinforcing metal fitting 71 further has a protruding wall reinforcing part 84, a coupling part 86 and a pair of curved part (the other long wall reinforcing part) 85. The protruding wall reinforcing part 84 is formed along the upper face of the island-shaped protruding wall 55. The coupling part 86 is disposed along the end face of the protruding wall 55 in the long side direction X, and couples the bottom wall part 82 to the protruding wall reinforcing part 84. The pair of curved parts 85 extends from the protruding wall reinforcing part 84 to the pair of long walls 54. The protruding wall reinforcing part 84 is branched into a T-shaped plate, and the apex face of the protruding wall reinforcing part 84 protects the protruding wall 55 from interference with the plug connector 20. The curved part 85 is curved into a U-shaped plate so as to cover the outer face of the long wall 54, and the apex face of the curved part 85 protects the long wall 54 from interference with the plug connector 20. Additionally, the protruding wall reinforcing part 84, the coupling part 86 and the curved part 85 ensure a heat radiation area.

Around the contact spring 83 of the reinforcing metal fitting 71, the apex face of the upper plate part 72, the plate thickness face 76 of the long wall reinforcing part 75 and the apex face of the curved part 85 are disposed. The apex face of the upper plate part 72, the plate thickness face 76 of the long wall reinforcing part 75 and the apex face of the curved part 85 are positioned above the contact spring 83. In a state where the plug connector 20 is displaced to the receptacle connector 50, the apex face of the upper plate part 72, the plate thickness face 76 of the long wall reinforcing part 75 and the apex face of the curved part 62 restrict the insertion of the plug connector 20 into the reception space 56 of the receptacle connector 50. Thereby, the plug connector 20 does not touch the contact spring 83, and the contact spring 83 is protected when the connectors interfere with each other.

As described above, the pair of long walls 54 is reinforced by the long wall reinforcing parts 75 of the pair of side plate parts 73. The long wall reinforcing part 75 is embedded in the long wall 54 with the plate face facing the inner side face of the long wall 54 and the plate thickness face 76 directed in a direction in which the long wall 54 is stood. Thereby, it becomes possible to decrease a thickness of the pair of long walls 54 and to decrease a size of the receptacle connector 50 in the short side direction Y. Accordingly, the pair of reinforcing metal fittings 71 is provided in both the end portions of the receptacle connector 50 in the long side direction X so that robustness of the receptacle connector 50 can be ensured, and the pair of long walls 54 is decreased in the thickness so that it becomes possible to realize decreasing of a size of the receptacle connector 50.

Figure 7A:
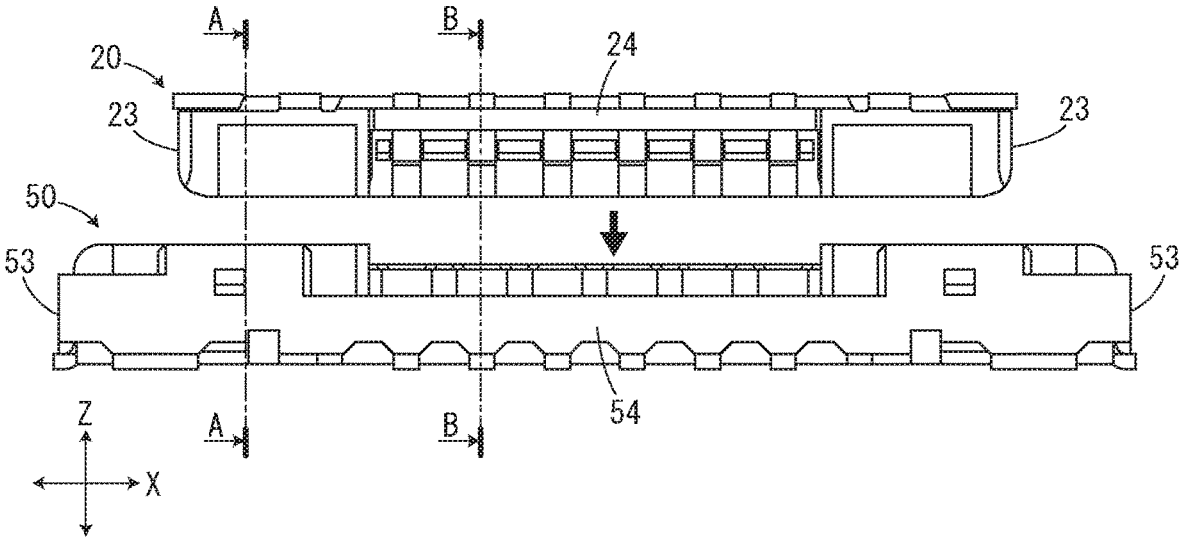
FIG. 7A is a side view showing a state where the connectors according to the present embodiment are removed from each other.
Figure 7B:
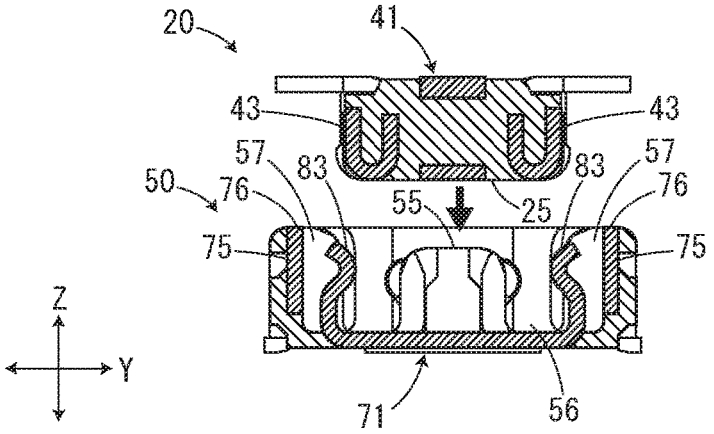
FIG. 7B is a sectional view showing the connectors taken along the line A-A in FIG. 7A.
Figure 7C:
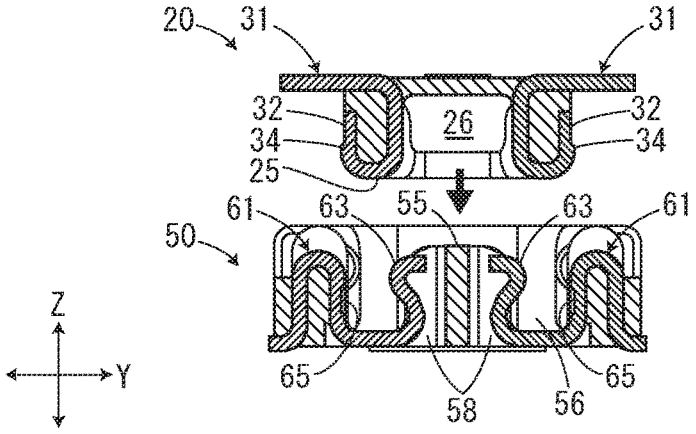
FIG. 7C is a sectional view showing the connectors taken along the line B-B in FIG. 7A.
Figure 8A:
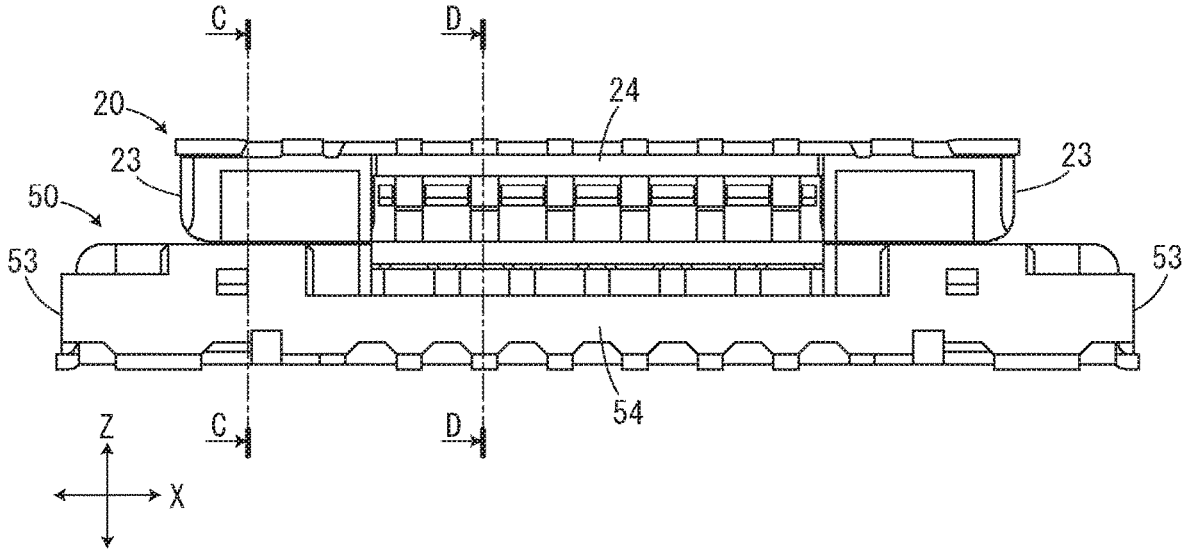
FIG. 8A is a view showing a connection operation when the connectors according to the present embodiment are displaced each other.
Figure 8B:
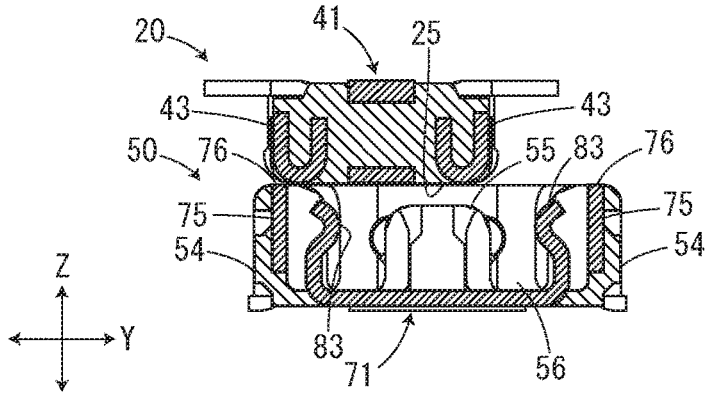
FIG. 8B is a sectional view showing the connectors taken along the line C-C in FIG. 8A.
Figure 8C:
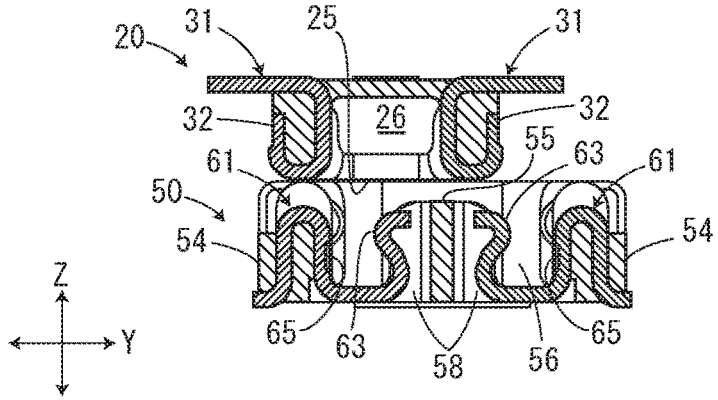
FIG. 8C is a sectional view showing the connectors taken along the line D-D in FIG. 8A.

With reference to FIG. 7A to 7C and FIG. 8A to 8C, a connection operation between the connectors will be described. FIG. 7A is a side view showing a state where the connectors are removed from each other. FIG. 7B is a sectional view showing the connectors taken along the line A-A in FIG. 7A. FIG. 7C is a sectional view showing the connectors taken along the line B-B in FIG. 7A. FIG. 8A is a view showing the connection operation when the connectors are displaced each other. FIG. 8B is a sectional view showing the connectors taken along the line C-C in FIG. 8A. FIG. 8C is a sectional view showing the connectors taken along the line D-D in FIG. 8A. In FIG. 7A to FIG. 7C and FIG. 8A to FIG. 8C, for convenience of description, the circuit board is not shown.

As shown in FIG. 7A, the plug connector 20 is disposed above the receptacle connector 50, and the plug connector 20 is positioned to the receptacle connector 50. When the plug connector 20 is correctly positioned to the receptacle connector 50, the fitting part 25 of the plug connector 20 is positioned just above the reception space (refer to FIG. 7B) of the receptacle connector 50. In this state, when the plug connector 20 is closer to the receptacle connector 50, the fitting part 25 of the plug connector 20 is inserted into the reception space 56 of the receptacle connector 50.

At this time, as shown in FIG. 7B, in the reinforcing metal fitting 71 of the receptacle connector 50, the tip end portion of the contact spring 83 is curved in a convex way, and the convex portion of the contact spring 83 is protruded from the storage groove 57 to the reception space 56. When the fitting part 25 of the plug connector 20 is inserted into the reception space 56 of the receptacle connector 50, the contact spring 83 in the reception space 56 is pushed into the storage groove 57 by the contact part 43 of the reinforcing metal fitting 41 of the fitting part 25. As a result, the contact spring 83 comes into contact with the contact part 43 by elastic force of the contact spring 83, and the reinforcing metal fitting 41 of the plug connector 20 is electrically connected to the reinforcing metal fitting 71 of the receptacle connector 50.

Additionally, as shown in FIG. 7C, in the signal terminal 61 of the receptacle connector 50, the tip end portion of the contact spring 63 is curved in a convex way, and the convex portion of the contact spring 63 is protruded from the storage groove 58 to the reception space 56. When the fitting part 25 of the plug connector 20 is inserted into the reception space 56 of the receptacle connector 50, the contact spring 63 in the reception space 56 is pushed into the storage groove 58 by the contact part 32 of the signal terminal 31 of the fitting part 25. As a result, the contact spring 63 comes into contact with the contact part 32 by elastic force of the contact spring 63, and the plurality of signal terminals 31 of the plug connector 20 is electrically connected to the plurality of signal terminals 61 of the receptacle connector 50. Additionally, the claw 34 of each signal terminal 31 is inserted into the concave face 65 of each signal terminal 61, and the plug connector 20 is prevented from being removed from the receptacle connector 50.

On the other hand, as shown in FIG. 8A and FIG. 8B, when the plug connector 20 is displaced to the receptacle connector 50, the fitting part 25 of the plug connector 20 is displaced to the reception space 56 of the receptacle connector 50. When the plug connector 20 is closer to the receptacle connector 50 in the above state, the fitting part 25 of the plug connector 20 abuts against the plate thickness face 76 of the long wall reinforcing part 75 exposed from the upper face of the long wall 54 of the receptacle connector 50. By abutting the fitting part 25 against the high rigid long wall reinforcing part 75, the long wall 54 is protected from an excessive load in the insertion and removal direction Z of the connector by the long wall reinforcing part 75.

As shown in FIG. 8B and FIG. 8C, the apex face (refer to FIG. 4) of the upper plate part 72, the plate thickness face 76 of the long wall reinforcing part 75 and the apex face (refer to FIG. 4) of the curved part 62 are positioned above the contact spring 83 of the reinforcing metal fitting 71 and the contact spring 63 of the signal terminal 61. Thereby, the fitting part 25 of the plug connector 20 is not inserted into the reception space 56 of the receptacle connector 50, and the fitting part 25 of the plug connector 20 does not directly abut against the contact springs 83 and 63 in the reception space 56. Accordingly, the contact springs 83 and 63 are prevented from being damaged owing to the interference of the contact springs 83 and 63 with the fitting part 25.

As described above, according to the present embodiment, even if the connectors 20 and 50 interfere with each other at the connection of the connectors 20 and 50, because the plate thickness face 76 of the long wall reinforcing part 75 is directed in a direction in which the long wall 54 of the housing 51 is stood, the long wall 54 is protected from an excessive load in the insertion and removal direction Z of the connector by the plate thickness face 76 of the long wall reinforcing part 75. Additionally, because the long wall reinforcing part 75 is formed by the side plate part 73, it becomes possible to decrease a thickness of the pair of long walls 54 and to decrease a size of the receptacle connector 50 in the short side direction Y. Accordingly, it becomes possible to realize decreasing of a size of the receptacle connector 50 while ensuring robustness of the receptacle connector 50.

Figure 9:
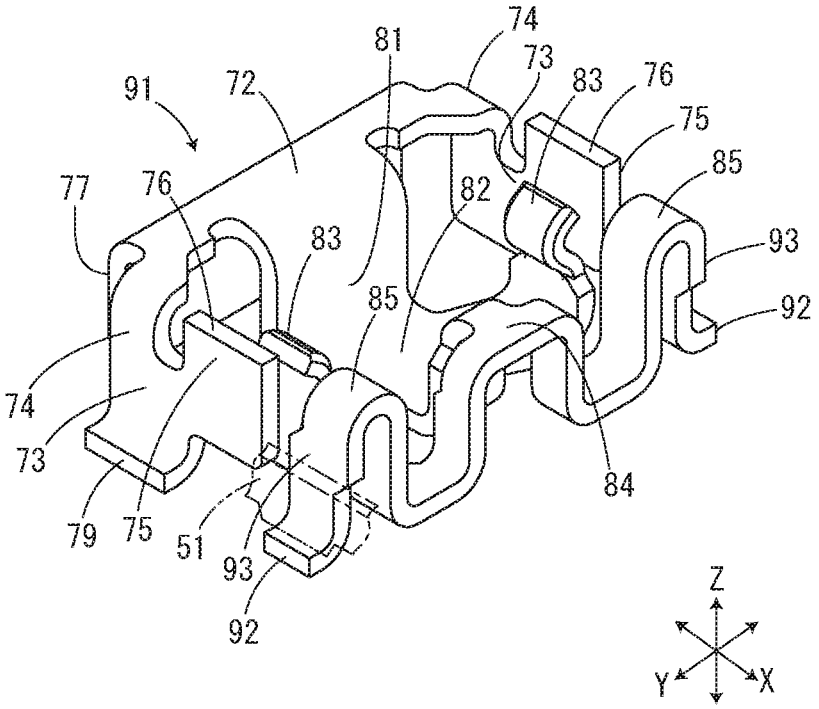
FIG. 9 is a perspective view showing the reinforcing fitting of a modified example.

Although the present embodiment has a configuration such that the reinforcing metal fitting 71 has the three mounting parts 78 and 79, the reinforcing metal fitting may have four or more mounting parts. For example, as shown in a modified example shown in FIG. 9, the reinforcing metal fitting 91 may have five mounting parts 78, 79 and 92 (the mounting part 78 is shown in FIG. 3). Hereinafter, the reinforcing metal fitting 91 of the modified example will be described briefly. The same configuration as the reinforcing metal fitting 71 of the present embodiment is marked with the same reference number, and its description is omitted. FIG. 9 shows a part of the housing 51 by the two-dotted chain line, for convenience of description. The reinforcing metal fitting 91 has leg parts 93 extending downward from the pair of curved parts 85 along the outer side face of the long wall 54 (refer to FIG. 4), and the mounting part 92 to be fixed to the mounting pad (not shown) is formed in the lower end portion of each leg part 93.

Thereby, the pair of contact springs 83 is electrically connected to the plurality of mounting parts 78, 79 and 92, and a current flowing through the reinforcing metal fitting 91 is further distributed so that it becomes possible to increase current capacity of a source current of the reinforcing metal fitting 91 and to increase a heat radiation area. The mounting part 92 is formed in the lower end portion of the leg part 93 extending downward from the curved part 85, and the curved part 85 is supported by the mounting part 92 from the lower side. Then, the mounting part 92 can receive a load applied with the curved part 85, and it becomes possible to further heighten robustness of the receptacle connector 50. Furthermore, because the leg part 93 is partially embedded in the housing 51, the solder lifting can be prevented when the mounting part 92 is soldered.

The present embodiment has a configuration such that the housing 51 is made of resin. However, the present embodiment is not limited to the configuration. The housing 51 may be made of electric isolation material.

The present embodiment has a configuration such that the reinforcing metal fitting 71 has the contact spring 83 and the reinforcing metal fitting 71 functions as a power terminal. However, the present embodiment is not limited to the above configuration. The reinforcing metal fitting 71 may not have the contact spring 83 and the reinforcing metal fitting 71 may not functions as a power terminal.

The present embodiment has a configuration such that the plate thickness face 76 of the long wall reinforcing part 75 is exposed from the upper face of the long wall 54. However, the present embodiment is not limited to the above configuration. The plate thickness face 76 of the long wall reinforcing part 75 is not necessarily exposed from the long wall 54. If the plate thickness face 76 of the long wall reinforcing part 75 is not exposed from the long wall 54, it becomes possible to reinforce the long wall 54 by the plate thickness face 76 of the long wall reinforcing part 75.

The reinforcing metal fitting 71 and the signal terminal 61 may be provided in the housing 51 by insertion molding. The reinforcing metal fitting 71 and the signal terminal 61 may be provided in the housing 51 by another molding way.

The plate thickness face 76 of the side plate part 73 is formed by an end face parallel to a plate thickness direction of the side plate part 73. However, the present embodiment is not limited to the above configuration. The plate thickness face 76 of the side plate part 73 may be an end face directed in a direction in which the long wall 54 is stood (upward), may be flat parallel to a plate thickness direction, or may be curved slightly.

As described above, the electric connector (the receptacle connector 50) of the present embodiment comprises the housing (51) formed into a rectangular shape in a plan view and having a plurality of signal terminals (61), and the pair of reinforcing metal fittings (71) reinforcing both end portions of the housing in a long side direction of the housing, the housing has a bottom wall (52) having a rectangular shape in a plan view, a pair of short walls (53) stood from both short sides of the bottom wall, a pair of long walls (54) stood from both long sides of the bottom wall, and an island-shaped protruding wall (55) surrounded by the pair of short walls and the pair of long walls, the reinforcing metal fitting has an upper plate part (72) along an upper face of the short wall, an outer plate part (77) extending from the upper plate part so as to be along an outer side face of the short wall, and a pair of side plate parts (73) extending from the upper plate part along inner side faces of the pair of long walls, and the pair of side plate parts has a mounting part (79) to be fixed to a mounting face and a long wall reinforcing wall part (75) whose plate thickness face (76) is directed in a direction in which the long wall (54) is stood. According to the above configuration, if the connectors interfere with each other at the connection of the connectors, because the plate thickness face of the long wall reinforcing part is directed in a direction in which the long wall is stood, the long wall is protected from an excessive load in the insertion and removal direction of the connector by the plate thickness face of the long wall reinforcing part. In this case, a load applied to the long wall reinforcing part can be received by the mounting part, and it becomes possible to heighten robustness of the electric connector. Additionally, because the long wall reinforcing part is formed by the side plate part, it becomes possible to decrease a thickness of the pair of long walls and to decrease a size of the electric connector in the short side direction. Accordingly, it becomes possible to realize a decreasing of a size of the electric connector while ensuring robustness of the electric connector.

In the electric connector according to the present embodiment, the reinforcing metal fitting has an inner plate part (81) extending from the upper plate part along an inner side face of the short wall, a bottom plate part (82) extending from the inner plate part along the bottom wall and a pair of contact springs (83) extending from the bottom wall part to the long wall and standing along the long wall. According to the above configuration, it becomes possible to use the reinforcing metal fitting for reinforcing the housing as a terminal.

In the electric connector according to the present embodiment, the outer plate part has a mounting part (78), and a space between the upper plate part and the mounting part connected to the outer plate part, and a space between the upper plate part and the mounting part (79) connected to the side plate part are embedded in the housing (51). According to the above configuration, when the mounting part is soldered to the mounting face, so-called solder lifting, in which the solder is lifted along the surface of the mounting part, is prevented by the housing. Additionally, the pair of contact springs is electrically connected to the plurality of mounting parts and a current flowing through the reinforcing metal fitting is distributed so that it becomes possible to increase current capacity.

In the electric connector according to the present embodiment, the contact spring faces the long wall reinforcing part, and between the contact spring and the long wall reinforcing part, a space for allowing flexure of the contact spring is formed. According to the above configuration, it becomes possible to flex the contact spring toward the long wall reinforcing part.

In the electric connector according to the present embodiment, the space is formed by a storage groove cut out the long wall of the housing, and the long wall reinforcing part is exposed through the storage groove. According to the above configuration, the space for allowing flexure of the contact spring is formed in the long wall by the storage groove so that it becomes possible to decrease a distance between the long walls and to decrease a size of the connector in the short side direction. The long wall reinforcing part is exposed to the space, and it becomes possible to improve heat radiation performance of the long wall reinforcing part.

In the electric connector according to the present embodiment, the reinforcing metal fitting has a protruding wall reinforcing part (84) along an upper face of the protruding wall, a coupling part (86) disposed along an end face of the protruding wall in a long side direction of the protruding wall and coupling the bottom plate part to the protruding wall reinforcing part, and a pair of other long wall (85) reinforcing parts extending from the protruding wall reinforcing part to the pair of long walls. According to the above configuration, it becomes possible to reinforce the protruding wall by the protruding wall reinforcing part and to reinforce the long wall by the other long wall reinforcing part.

In the electric connector according to the present embodiment, an apex face of the upper plate part, an apex face of the other long wall reinforcing part and the plate thickness face of the long wall reinforcing part are positioned above the contact spring. The apex face of the upper plate part, the apex face of the other long wall reinforcing part and the plate thickness face of the long wall reinforcing part make it possible to protect the contact spring when the connectors interfere with each other.

In the electric connector according to the present embodiment, a leg part (93) extends downward from the other long wall reinforcing part along an outer side face of the long wall, other mounting part to be fixed to a mounting face is formed in a lower end portion of the leg part, and the leg part is partially embedded in the housing. According to the above configuration, the pair of contact springs is electrically connected to the plurality of mounting parts, and a current flowing through the reinforcing metal fitting is further distributed so that it becomes possible to increase current capacity of a source current of the reinforcing metal fitting and to increase a heat radiation area. Additionally, the mounting part is formed in the lower end portion of the leg part extending downward from the curved part, and the other long wall reinforcing part is supported by the other mounting part from the lower side. Then, a load applied to the other long wall reinforcing part can be received by the other mounting part, and it becomes possible to further heighten robustness of the power connector. Furthermore, the solder lifting can be prevented by the housing when the mounting part is soldered.

Although the present embodiment has been described, the present embodiment and the modified example may be combined collectively or partially as another embodiment.

Further, the technique of the present invention is not limited to the above described embodiments, and may be variously modified, replaced and changed without departing from the spirit of the technical idea. Further, if the technical idea can be realized in another manner by the development of technology or another technology derived from it, it may be realized in the manner. Accordingly, the claims cover all embodiments that may be included within the scope of the technical idea.

The invention claimed is:

1. An electric connector comprising a housing and a pair of reinforcing metal fittings, wherein the housing is formed into a rectangular shape in a plan view and has a plurality of signal terminals, and the pair of reinforcing metal fittings reinforces both end portions of the housing in a long side direction of the housing, the housing has a bottom wall having a rectangular shape in the plan view, a pair of short walls stood from both short sides of the bottom wall, a pair of long walls stood from both long sides of the bottom wall, and an island-shaped protruding wall surrounded by the pair of short walls and the pair of long walls, each of the pair of reinforcing metal fittings has an upper plate part along an upper face of a respective one of the pair of short walls, an outer plate part extending from the upper plate part so as to be along an outer side face of the respective one of the pair of short walls, and a pair of side plate parts extending from the upper plate part along inner side faces of the pair of long walls, the pair of side plate parts each have a mounting part to be fixed to a mounting face and a long wall reinforcing wall part to reinforce the long wall is stood, and an upper end face of the long wall reinforcing part is exposed from an upper face of the long wall.

2. The electric connector according to claim 1, wherein each of the pair of reinforcing metal fittings has an inner plate part extending from the upper plate part along an inner side face of the respective one of the pair of short walls, a bottom plate part extending from the inner plate part along the bottom wall and a pair of contact springs each extending from the bottom wall part to a respective one of the pair of long walls and standing along the respective one of the pair of long walls.

3. The electric connector according to claim 2, wherein the outer plate part has a second mounting part, and a portion between the upper plate part and the second mounting part and another portion between the upper plate part and the mounting part connected to the side plate part are embedded in the housing.

4. The electric connector according to claim 2, wherein the each of the pair of contact springs face the long wall reinforcing part of a respective one of the pair of side plates, and between each of the pair of contact springs and the long wall reinforcing part of the respective one of the pair of side plates, a space for allowing flexure of the contact spring is formed.

5. The electric connector according to claim 4, wherein the space is formed by a storage groove cut out each of the pair of long walls of the housing, and each of the long wall reinforcing parts is exposed through the storage groove.

6. The electric connector according to claim 2, wherein each of the pair of reinforcing metal fittings has a protruding wall reinforcing part along an upper face of the protruding wall, a coupling part disposed along an end face of the protruding wall in a long side direction of the protruding wall and coupling the bottom plate part to the protruding wall reinforcing part, and a pair of other long wall reinforcing parts extending from the protruding wall reinforcing part to the pair of long walls.

7. The electric connector according to claim 6, wherein an apex face of the upper plate part, an apex face of the other long wall reinforcing part and a portion of the long wall reinforcing part are positioned above the contact spring.

8. The electric connector according to claim 7, wherein a leg part extends downward from the other long wall reinforcing part along an outer side face of the long wall, other mounting part to be fixed to a mounting face is formed in a lower end portion of the leg part, and the leg part is partially embedded in the housing.

* * * * *